US007522132B2

(12) United States Patent
Hamamoto et al.

(10) Patent No.: US 7,522,132 B2
(45) Date of Patent: Apr. 21, 2009

(54) IMAGE DISPLAY APPARATUS

(75) Inventors: Yasuhiro Hamamoto, Yokohama (JP); Takahiro Oguchi, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 740 days.

(21) Appl. No.: 11/061,654

(22) Filed: Feb. 22, 2005

(65) Prior Publication Data

US 2005/0206634 A1 Sep. 22, 2005

(30) Foreign Application Priority Data

Mar. 17, 2004 (JP) ..... 2004-076108

(51) Int. Cl.
*G09G 3/20* (2006.01)
*G09G 3/22* (2006.01)

(52) U.S. Cl. ..... 345/75.2; 345/76; 345/82

(58) Field of Classification Search ..... 345/30–111, 345/204

See application file for complete search history.

(56) References Cited

U.S. PATENT DOCUMENTS

| | | | | |
|---|---|---|---|---|
| 5,510,858 | A | 4/1996 | Shido et al. | 348/718 |
| 5,555,000 | A | 9/1996 | Sarrasin et al. | 345/75 |
| 5,778,134 | A | 7/1998 | Sakai et al. | 386/46 |
| 6,515,641 | B1 | 2/2003 | Sagano et al. | 345/76 |
| 6,933,935 | B2 | 8/2005 | Sagano et al. | 345/204 |
| 2002/0171608 | A1 * | 11/2002 | Kanai et al. | 345/55 |
| 2003/0016195 | A1 | 1/2003 | Sagano et al. | 345/75.2 |
| 2005/0017932 | A1 | 1/2005 | Sagano et al. | 345/76 |

FOREIGN PATENT DOCUMENTS

| | | |
|---|---|---|
| EP | 0 660 357 A1 | 6/1995 |
| EP | 0 942 449 A2 | 9/1999 |
| EP | 1 124 248 A2 | 8/2001 |
| EP | 1 258 907 A2 | 11/2002 |
| JP | 7-181917 | 7/1995 |
| JP | 7-235255 | 9/1995 |
| JP | 2000-310969 | 11/2000 |
| JP | 2003-029697 | 1/2003 |

* cited by examiner

*Primary Examiner*—Amr Awad
*Assistant Examiner*—Michael Pervan
(74) *Attorney, Agent, or Firm*—Fitzpatrick, Cella, Harper & Scinto

(57) ABSTRACT

An image display apparatus capable of displaying a preferable image whose dark place contrast has a large value and whose color-reproducibility and gray-level reproducibility are excellent. A voltage level of a scanning selective signal is changed in response to a request from outside or the like, so that a black level luminance is reduced to improve dark place contrast. In addition, when the voltage level of the scanning selective signal is changed, a conversion table for converting an input luminance into a modulation signal is changed to another conversion table. Therefore, for example, it is possible to maintain a display gray-level characteristic before and after the voltage level of the scanning selective signal is changed.

10 Claims, 10 Drawing Sheets

MODULATION LEVEL
1 TO L1max

MODULATION LEVEL
L1max+1 TO L2max

MODULATION LEVEL
L2max+1 TO L3max

MODULATION LEVEL
L3max+1 TO L4max.

IMAGE DISPLAY APPARATUS

BACKGROUND OF THE INVENTION

1. Field of the Invention

The present invention relates to an image display apparatus including a display panel in which a plurality of image forming devices are wired in a matrix.

2. Related Background Art

A display in which a phosphor and a minute electron-emitting device are arranged for each pixel, a display using electroluminescence, a display in which a large number of light-emitting diodes are arranged, or the like can be provided as a planar self-light-emission type image display apparatus.

For example, U.S. Pat. No. 5,659,329, Japanese Patent Application Laid-Open Nos. H07-235255, 2000-310969, and H07-181917 made by the applicant of the application are enumerated as examples in which a passive matrix structure in which a large number of surface conduction electron-emitting devices (hereinafter referred to as SCE devices) serving as electron-emitting devices are arranged is applied to an image display apparatus.

According to an electron-emitting device, a manufacturing method thereof, and the like as described in U.S. Pat. No. 5,659,329, Japanese Patent Application Laid-Open Nos. H07-235255, 2000-310969, and H07-181917, a plurality of surface conduction electron-emitting devices are two-dimensionally arranged. Each of the surface conduction electron-emitting devices includes a set of device electrodes provided on a substrate, an electroconductive film connected with the set of device electrodes, and an electron-emitting region formed in the electroconductive film. An electrical selection means for separately selecting electrons emitted from the respective electron-emitting devices is provided. An image is formed according to an input signal.

According to Japanese Patent Application Laid-Open No. 2000-310969, there has been disclosed a method of driving an image forming apparatus using the surface conduction electron-emitting devices to preferably display various kinds of image signals. In Japanese Patent Application Laid-Open No. 2000-310969, there has been proposed that, when the image is to be displayed by a pulse width modulation method or an amplitude modulation method, a characteristic of an image signal is determined and a potential of a modulation pulse signal is set according to a kind of signal to be displayed. In addition, a potential setting circuit is provided such that a potential of a so-called scanning signal can be changed.

According to Japanese Patent Application Laid-Open Nos. H07-181917, there have been disclosed a micro-chip type phosphor display and a controlling method and apparatus therefor. As described in Japanese Patent Application Laid-Open Nos. H07-181917, a period of a modulation pulse signal is divided into a plurality of periods and a plurality of discrete pulse voltages outputted during each of the divided periods are prepared to increase displayable gray-levels. In addition, the plurality of pulse voltages used to produce the modulation pulse signal are controlled by a controller, so that a discrete voltage generator is controlled in accordance with the demand from a user.

In general, in a self-light-emission type display using cathodeluminescence, electroluminescence, or the like, a displayable maximal luminance (referred to as a peak luminance) or a luminance caused when an image is displayed with minimal gray-level in a dark place (referred to as a black level luminance in a dark place) is determined based on a drive voltage applied to an image forming device corresponding to each pixel. The maximal luminance divided by the black level luminance in the dark place is referred to as dark place contrast. The dark place contrast is one of factors important to determine the quality of a display image. When the dark place contrast takes a large value, a preferable image is obtained.

When an image having a low average luminance level, such as a movie picture is viewed in the dark place, the dark place contrast is particularly important. However, the dark place contrast of the above-mentioned planar image display apparatus is not necessarily sufficient.

SUMMARY OF THE INVENTION

An object of the present invention is to provide an image display apparatus capable of displaying a preferable image whose dark place contrast has a large value and whose color-reproducibility and gray-level reproducibility are excellent.

According to the present invention, a scanning selective voltage is selected based on a video source to be displayed to perform image display suitable for the video source on a display panel whose logarithmic characteristic of a luminance reflecting a visual characteristic is a predetermined characteristic.

The present invention provides an image display apparatus, including:

a plurality of image forming devices which are driven through a plurality of row wirings and a plurality of column wirings and arranged in a matrix for image formation;

scanning means for successively selecting the row wirings to output a scanning selective signal;

modulation means for outputting modulation signals corresponding to image data, which are applied to the column wirings; and scanning voltage control means for commanding to change a voltage level of the scanning selective signal in response to a display control signal, the scanning means outputting the scanning selective signal whose voltage level is changed in response to a scanning voltage control signal from the scanning voltage control means.

Further, preferably, provided that a light emission luminance value obtained when a drive voltage v is applied to each of the image forming devices is given by L(v), a first-order differential coefficient of the light emission luminance value L(v) to the drive voltage v is given by L'(v), and a second-order differential coefficient thereof is given by L"(v), $$L'(v)>0 \text{ and } L''(v)\times L(v)<\{L'(v)\}^2$$

are satisfied in a range of the drive voltage v for image display.

Here, the drive voltage v indicates a voltage actually applied to the image forming device, which is a voltage obtained by subtracting voltage drop caused by a wiring resistance and the like from a voltage difference between the scanning selective signal corresponding to the image forming device selected for displaying and the modulation signal.

According to the present invention, a simple structure is used. Therefore, a normal display mode or a high contrast display mode suitable to view, for example, a movie picture can be selected by input from a user or automatic determination of the image display apparatus to display an input video source.

DETAILED DESCRIPTION OF THE PREFERRED EMBODIMENTS

Hereinafter, preferred embodiments of the present invention will be described by examples in detail with reference to the drawings.

A light emission characteristic of a display panel to which the present invention can be applied will be described with reference to FIG. 1.

Figure 1:
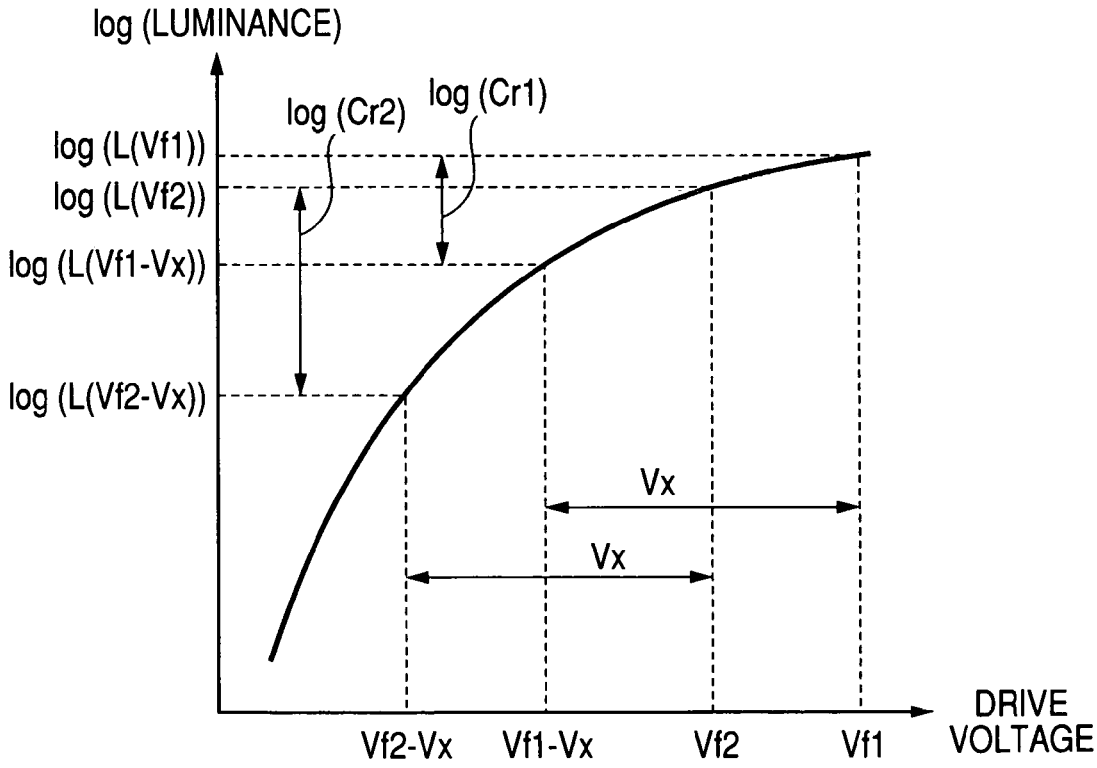
FIG. 1 is a graph showing a light emission characteristic of an image forming device which can be applied to an image display apparatus.

FIG. 1 is a graph showing a relationship between a drive voltage and a light emission luminance of the display panel in the case where an SCE device is used as an image forming device. In FIG. 1, the abscissa indicates a device voltage applied between device electrodes (drive voltage) and the ordinate indicates the logarithm of the light emission luminance. Note that the light emission luminance is obtained by measuring cathodeluminescence light from an anode electrode with a phosphor, which is located above the SCE device by a luminance meter.

As shown in FIG. 1, a log (luminance) to drive voltage curve of the image forming device to which the present invention can be applied indicates a monotonic increase and protrudes upward. That is, when a light emission luminance value of the image forming device to the drive voltage v thereof is given by L(v), a first-order differential coefficient of L(v) to v is given by L'(v), and a second-order differential coefficient thereof is given by L"(v), the light emission characteristic is expressed by the following expression, $$L'(v)>0 \text{ and } L''(v)\times L(v)<\{L'(v)\}^2 \qquad \text{(Expression 1)}$$

Expression 1 is derived from a condition of y'>0 and y">0 in y=log L(v).

In the display panel having such a characteristic, a ratio between luminances corresponding to drive voltages Vf and (Vf−Vx) which are different from each other by a voltage difference Vx, L(Vf)/L(Vf−Vx) is given by Cr. In this case, when a luminance ratio between Vf1 and (Vf1−Vx) and a luminance ratio between Vf2 and (Vf2−Vx) are given by Cr1 and Cr2, respectively, a relationship expressed by the following expression is always established in a voltage range in which Expression 1 is satisfied.

$$\text{When } Vf1>Vf2,\ Cr1<Cr2 \qquad \text{(Expression 2)}$$

That is, when a dynamic range of the drive voltage is set to a low voltage side in the display panel having the luminance characteristic as shown in FIG. 1, dark place contrast significantly improves.

When the light emission characteristic expressed by Expression 1 is attained in a practical drive voltage range, the present invention can be applied to not only the SCE device but also an image forming device such as a general field emission type electron-emitting device, a ballistic electron surface-emitting device (BSD), an electroluminescent (EL) device, or a light-emitting diode (LED) device.

Figure 2:
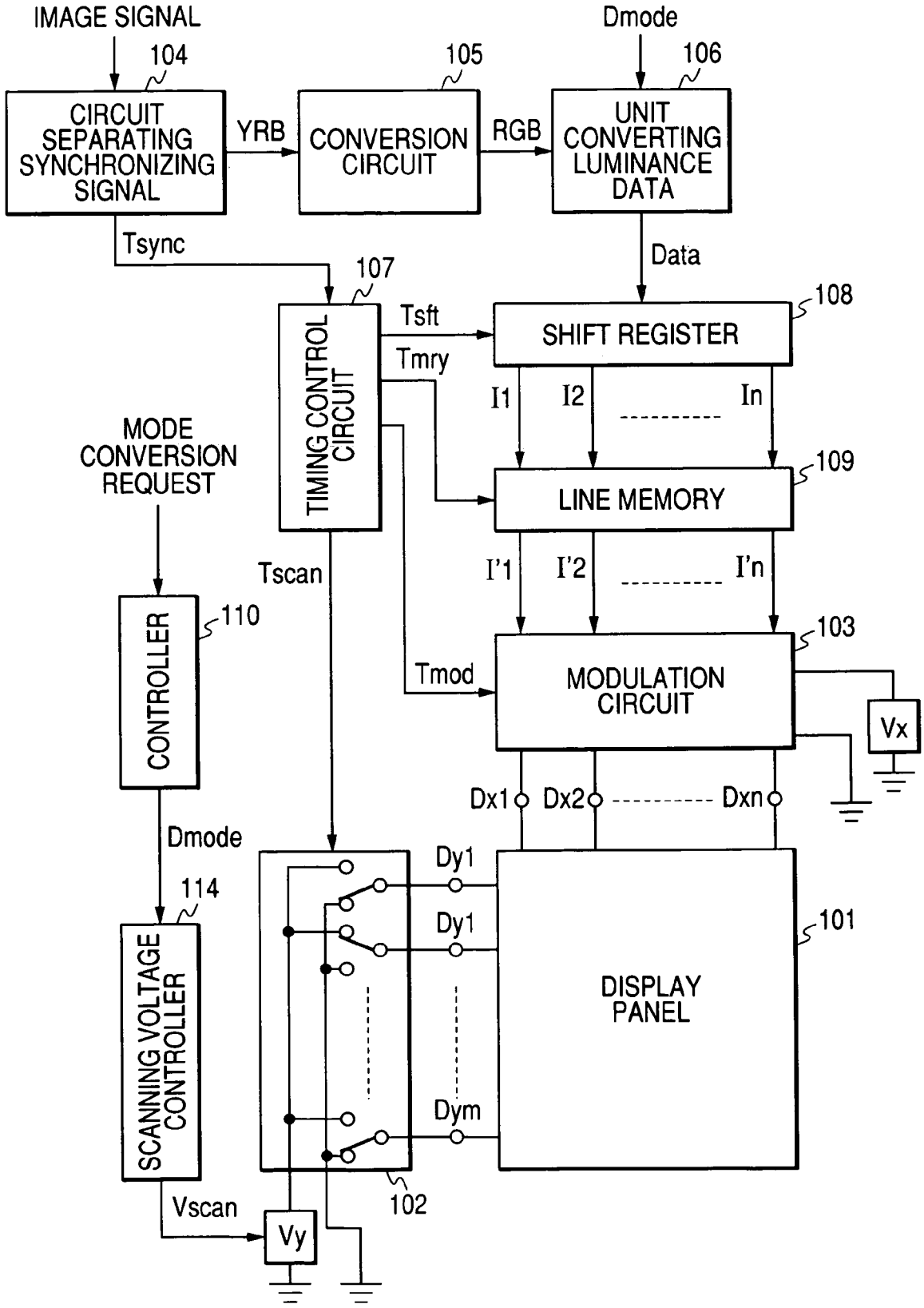
FIG. 2 is an explanatory block diagram showing the image display apparatus according to the present invention.

Next, an image display apparatus of the present invention will be described with reference to FIG. 2. FIG. 2 is a block diagram showing an example of a circuit structure for realizing the image display apparatus of the present invention.

In FIG. 2, the image display apparatus includes a display panel 101 in which a plurality of image forming devices are wired in a passive matrix, a scanning circuit 102 serving as an example of a scanning means, a modulation circuit 103 serving as an example of a modulation means, a synchronizing signal separating circuit 104, an RGB conversion circuit 105 for converting a YRB signal from the synchronizing signal separating circuit 104 into an RGB signal, a luminance data converting unit 106 for converting luminance information of each of RGB colors into a modulation intensity, a timing control circuit 107, a shift register 108 for image data corresponding to one line, a line memory 109 for image data corresponding to one line, and a controller 110. Reference symbols Dy1 to Dym denote row wiring terminals for row wirings of the display panel 101, and Dx1 to Dxn denote column wiring terminals for column wirings of the display panel 101.

When each of the image forming devices emits light using cathodeluminescence, a high-voltage power source (not shown) for accelerating the emitted electrons is connected with a high-voltage terminal (not shown) of the display panel 101.

(Synchronizing Signal Separating Circuit and Timing Control Circuit)

A synchronizing signal Tsync (including a vertical synchronizing signal and a horizontal synchronizing signal) is separated from image data inputted to the image display apparatus by the synchronizing signal separating circuit 104 and supplied to the timing control circuit 107. A video signal (YRB signal) is converted into a digital RGB signal by the RGB conversion circuit 105 and supplied to the luminance data converting unit 106.

The luminance data converting unit 106 produces modulation signal information corresponding to each of RGB input values and associates the digital RGB signal with a modulation amount used in the modulation circuit 103. The luminance data converting unit 106 has a storing means for storing a conversion table for converting the digital RGB signal into the modulation signal information. The modulation signal information is numerical information corresponding to each of a plurality of modulation levels which can be expressed by the modulation circuit 103 on a one-to-one basis. The conversion table is constructed such that stored contents can be changed by external control. When a plurality of conversion tables are provided, a conversion table used for conversion can be selected therefrom according to a control signal from the outside.

When a mode conversion request signal is inputted with a remote controller, a switch, or the like by a user, the controller 110 serving as an example of a display control means supplies a display mode selection/change signal Dmode to each part.

Alternatively it is possible that the controller 110 receives an image data input, automatically discerns the sort of image source on the image data and supplies a display mode selection/change signal Dmode to each part.

The timing control circuit 107 determines operational timing of each part in synchronization with the synchronizing signal Tsync of a video source. That is, the timing control circuit 107 generates signals such as a signal Tsft for controlling operational timing of the shift register 108, a signal Tmry for controlling operational timing of the line memory 109, a signal Tmod for controlling operational timing of the modulation circuit 103, and a signal Tscan for controlling operational timing of the scanning circuit 102.

(Scanning Circuit)

The scanning circuit 102 is a circuit that outputs a scanning selective signal voltage Vy or a nonselective potential (for example, 0 V) to each of the wiring terminals Dy1 to Dym in order to successively scan the display panel 101 line by line. The scanning circuit 102 includes m switches. These switches are preferably composed of transistors or FETs.

A value of the scanning selective signal voltage Vy and a value of a modulation signal described later, which are outputted from the scanning circuit 102 may be determined based on a light emission luminance-to-drive voltage characteristic of an image forming device to be used.

The scanning selective signal voltage Vy outputted from the scanning circuit 102 is controlled according to a scanning voltage control signal Vscan sent from a scanning voltage controller 114. The scanning voltage controller 114 is controlled according to the display mode selection/change signal Dmode as a display control signal, which is sent from the controller 110. The scanning voltage controller 114 outputs a scanning voltage control signal Vscan to the scanning circuit 102 as a command to change the scanning selective signal voltage Vy. Therefore, the scanning circuit 102 is constructed such that the scanning selective signal voltage Vy can be changed in response to a request from the controller 110 through the scanning voltage controller 114.

(Shift Register, Line Memory, and Modulation Circuit)

The modulation signal information into which the image data is converted by the luminance data converting unit 106 is subjected to serial/parallel conversion by the shift register 108 and stored in the line memory 109 during a horizontal scanning period. The modulation circuit 103 outputs modulation signals to the corresponding column wiring terminals Dx1 to Dxn of the display panel 101 based on modulation signal information I'1 to I'n stored in the line memory 109.

It is preferable to use a pulse width modulation method of mainly changing a pulse width according to modulation signal information, an amplitude modulation method of mainly changing an amplitude of a voltage pulse according to modulation signal information, a pulse width modulation method using a plurality of voltage amplitude values, or the like as a modulation method realized in the modulation circuit 103.

First Embodiment

A first embodiment of the present invention will be described based on the above-mentioned fundamental structure.

Figure 3:
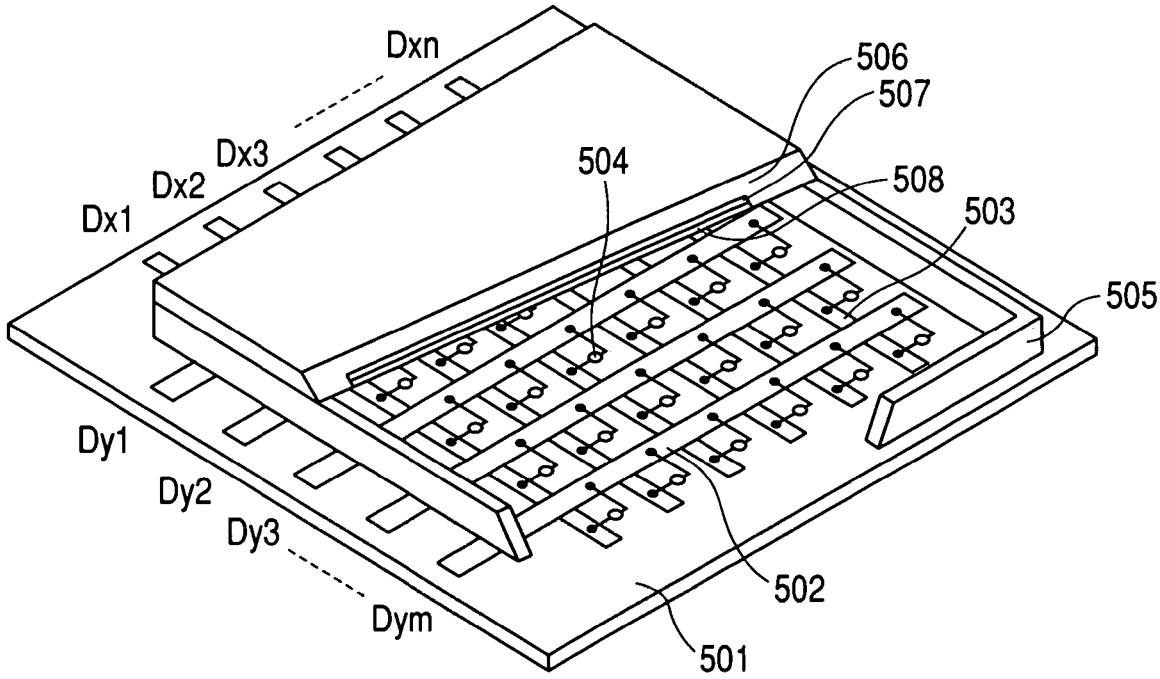
FIG. 3 is a schematic perspective view showing a display panel which can be applied to the image display apparatus.

A display panel having a structure shown in FIG. 3 is used as the display panel 101. An SCE device is used as the image forming device. In FIG. 3, the display panel includes an electron source plate 501, row wirings 502, column wirings 503, and SCE devices 504. Phosphors 507 corresponding to the respective SCE elements and an electrode (referred to as an anode electrode) 508 electrically connected with the phosphors 507 are formed on the opposed electron source plate 501 side of a face plate 506 composed of a transparent substrate. The electron source plate 501 and the face plate 506 are sealed with an envelope 505, so that an inner portion is maintained to a vacuum state. Although not shown in FIG. 2, a direct-current high voltage is applied from the high-voltage power source (not shown) to the anode electrode 508 of the display panel 101 through the high-voltage terminal (not shown).

A pulse width modulation method is used as the modulation method for the modulation circuit 103. That is, the modulation circuit 103 is a circuit using a pulse width modulation method, which outputs a voltage pulse having a predetermined peak value Vx and can suitably modulate a pulse width thereof according to inputted modulation signal information.

The image display apparatus according to this embodiment can display an image based on two kinds of display modes in response to the display mode selection/change signal Dmode outputted from the controller 110. Drive voltages are set as shown in Table 1 based on the display modes.

TABLE 1

| | Vy | Vx |
|---|---|---|
| Condition 1 | −10 V | +5 V |
| Condition 2 | −9 V | +5 V |

As shown in Table 1, the amplitudes Vx of the modulation pulses in the respective modes are equal to each other. The scanning selective signal voltages Vy from the scanning circuit 102 in the respective modes are different from each other. When a value of a light luminance portion (both Vy and Vx are applied) and a value of a dark luminance portion (Vy is applied and Vx is not applied) are measured in a dark place under the above-mentioned drive conditions, a result shown in Table 2 is obtained.

TABLE 2

| | Light Luminance Portion | Dark Luminance Portion | Dark Contrast |
|---|---|---|---|
| Condition 1 | 300 cd/m$^2$ | 0.60 cd/m$^2$ | 500:1 |
| Condition 2 | 150 cd/m$^2$ | 0.07 cd/m$^2$ | No less than 2000:1 |

Therefore, a contrast ratio is high under the drive condition 2. Thus, it is found that an image suitable to view a movie picture or the like can be displayed.

The voltage values and the measurement values as shown in Tables 1 and 2 vary according to a condition for producing the SCE device, a structural size thereof, a set value of an accelerating voltage, a set value of a maximal pulse width, and the like. However, in any case, when the amplitude Vx of the modulation pulse is kept constant and the value of the scanning selective signal voltage Vy is changed such that the drive voltage reduces, a contrast ratio is improved.

With respect to the conversion table of the luminance data converting unit 106, conversion tables having contents different from each other are used corresponding to the respective display modes to determine a width of the modulation pulse. Assume that the respective conversion tables are indicated by reference symbols F1 and F2.

Figure 4A:
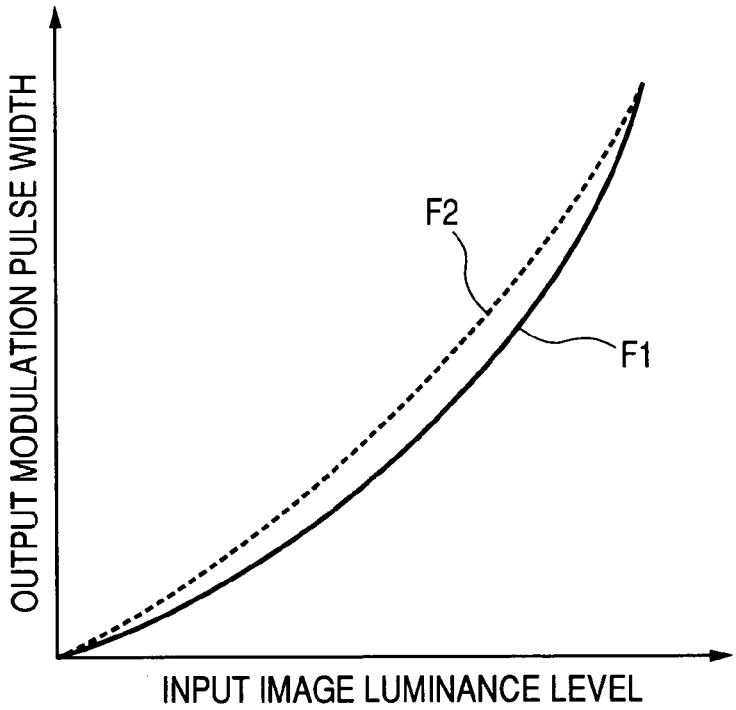
FIGS. 4A and 4B are graphs each showing a relationship between an input image luminance and an output modulation pulse width which are associated with each other by a conversion table used in a first embodiment of the present invention.

FIG. 4A shows a relationship between the input image luminance level and an output modulation pulse width which are associated with each other by the conversion table. In FIG. 4A, an input and output relationship related to the conversion using the conversion table F1 corresponding to the drive condition 1 is indicated by a solid line and an input and output relationship related to the conversion using the conversion table F2 corresponding to the drive condition 2 is indicated by a broken line. When the input image luminance level reaches a minimal value and a maximal value, the conversion tables F1 and F2 have substantially the same output modulation pulse width. Therefore, the relationship between the input image luminance level and the output modulation pulse width indicates a monotonic increase.

Note that the conversion tables F1 and F2 are set such that an output modulation pulse width obtained by conversion using the conversion table F2 becomes equal to or larger than an output modulation pulse width obtained by conversion using the conversion table F1 when the input image luminance levels are equal to each other.

The reason why the conversion tables F1 and F2 in this embodiment are set to obtain a relationship as shown in FIG. 4A is based on mainly an optical response characteristic of the phosphor. That is, this is based on the fact that the SCE device has a characteristic in that quantum efficiency reduces as a drive pulse width lengthens or an irradiation current density increases because of a saturation phenomenon of an excitation site. Therefore, when a drive voltage Vx-Vy is low in the drive condition 2, an output modulation pulse width in the drive condition 2 becomes equal to or larger than an output modulation pulse width in the drive condition 1. Thus, an emission current reduces, so that the tendency of saturation of the phosphor becomes weaker.

Figure 4B:
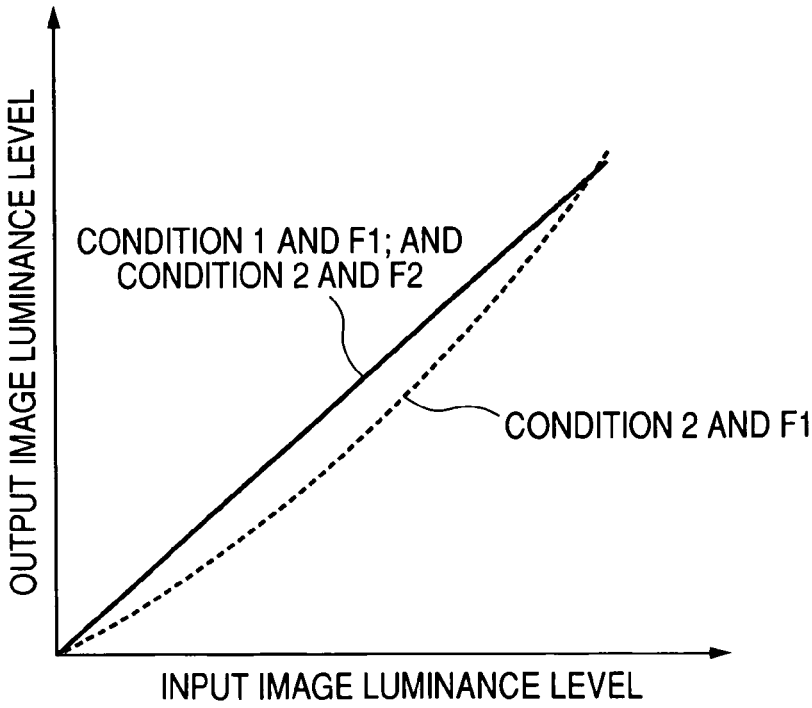

FIG. 4B shows a relationship between an input image luminance level and an output image luminance level in this embodiment. As shown in FIG. 4B, when an image is displayed using the conversion table F1 in the drive condition 2 as in the case of the drive condition 1, a relationship as indicated by a broken line in FIG. 4B is obtained. Therefore, a relative luminance balance of the displayed image is different from that in the drive condition 1. However, as described in this embodiment, when the conversion table is set to F2 in the drive condition 2, a relationship as indicated by a solid line in FIG. 4B is obtained. Thus, it is possible to maintain the same relative luminance balance as that in the case where the conversion table is set to F1 in the drive condition 1.

As described above, the conversion table shown in FIG. 4A is set such that a relative value of the output image luminance level to the input image luminance level in the drive condition 1 is equal to that in the drive condition 2.

Second Embodiment

In an image display apparatus according to a second embodiment, an amplitude modulation method is employed for the modulation circuit 103 shown in FIG. 2. That is, the modulation circuit 103 is a circuit using an amplitude modulation method, which outputs a voltage pulse having a predetermined pulse width and can suitably modulate a peak value thereof according to inputted modulation signal information. A maximal peak value of the pulse voltage is specified by using a power source voltage Vx. Other structures are identical to those in the first embodiment and thus the description is omitted here.

The image display apparatus according to this embodiment can display an image based on two kinds of display modes in response to the display mode selection/change signal Dmode outputted from the controller 110. Drive voltages are set as shown in Table 1 based on the display modes.

TABLE 3

| | Vy | Vx |
|---|---|---|
| Condition 1 | −10 V | +5 V |
| Condition 2 | −9 V | +5 V |

As shown in Table 3, the maximum amplitudes Vx of the modulation pulses in the respective modes are equal to each other. The scanning selective signal voltages Vy from the scanning circuit 102 in the respective modes are different from each other. When a value of a light luminance portion (both Vy and Vx are applied) and a value of a dark luminance portion (Vy is applied and Vx is applied with the minimum output level) are measured in a dark place under the above-mentioned drive conditions, a result shown in Table 4 is obtained.

TABLE 4

| | Light Luminance Portion | Dark Luminance Portion | Dark Contrast |
|---|---|---|---|
| Condition 1 | 300 cd/m$^2$ | 0.60 cd/m$^2$ | 500:1 |
| Condition 2 | 150 cd/m$^2$ | 0.07 cd/m$^2$ | No less than 2000:1 |

Therefore, a contrast ratio is high under the drive condition 2. Thus, it is found that an image suitable to view a movie picture or the like can be displayed.

With respect to the conversion table of the luminance data converting unit 106, conversion tables having contents different from each other are used corresponding to the respective display modes to determine a width of the modulation pulse. Assume that the respective conversion tables are indicated by reference symbols F1 and F2.

Figure 5A:
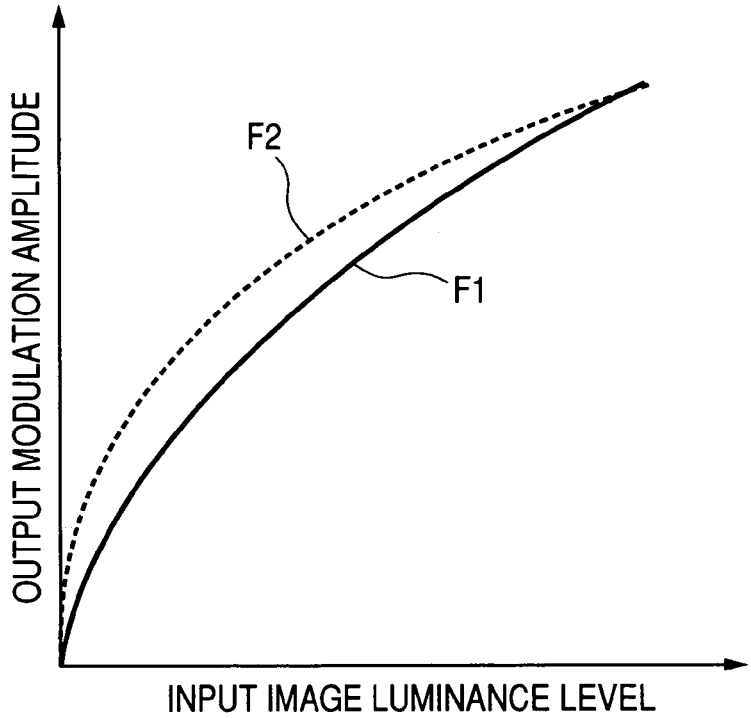
FIGS. 5A and 5B are graphs each showing a relationship between an input image luminance and an output modulation amplitude which are associated with each other by a conversion table used in a second embodiment of the present invention.

FIG. 5A shows a relationship between the input image luminance level and an output modulation amplitude which are associated with each other by the conversion table. In FIG. 5A, an input and output relationship related to the conversion using the conversion table F1 corresponding to the drive condition 1 is indicated by a solid line and an input and output relationship related to the conversion using the conversion table F2 corresponding to the drive condition 2 is indicated by a broken line. When the input image luminance level reaches a minimal value and a maximal value, the conversion tables F1 and F2 have substantially the same output modulation amplitude value. Therefore, the relationship between the input image luminance level and the output modulation amplitude indicates a monotonic increase. Note that the conversion tables F1 and F2 are set such that an output modulation amplitude value obtained by conversion using F2 becomes equal to or larger than an output modulation amplitude value obtained by conversion using F1 when the input image luminance levels are equal to each other.

Figure 5B:
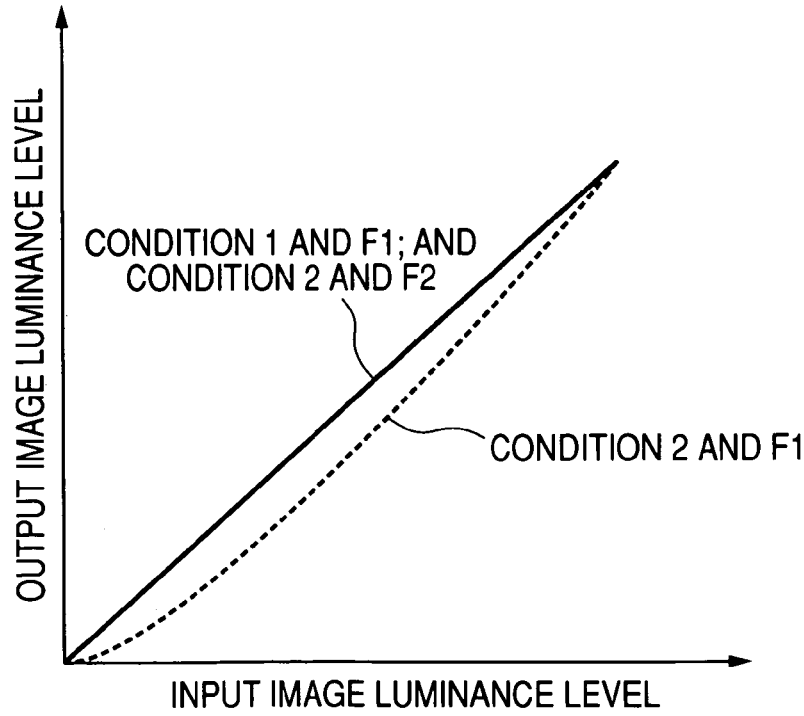
Figure 6A:
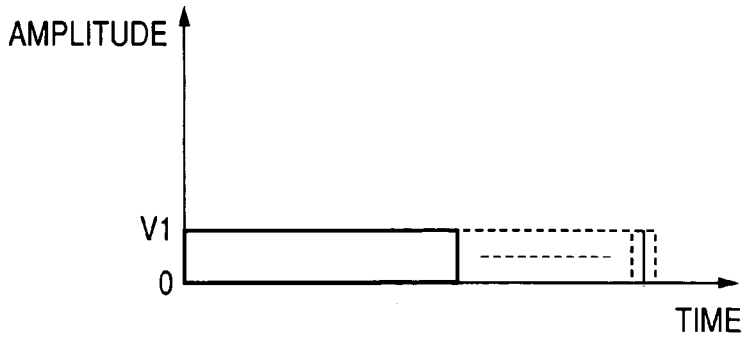
FIGS. 6A, 6B, 6C and 6D are schematic explanatory diagrams showing shapes of modulation pulses produced by a modulation method using combinations of plural stages of amplitudes and plural stages of pulse widths, which are used in a third embodiment of the present invention.
Figure 6B:
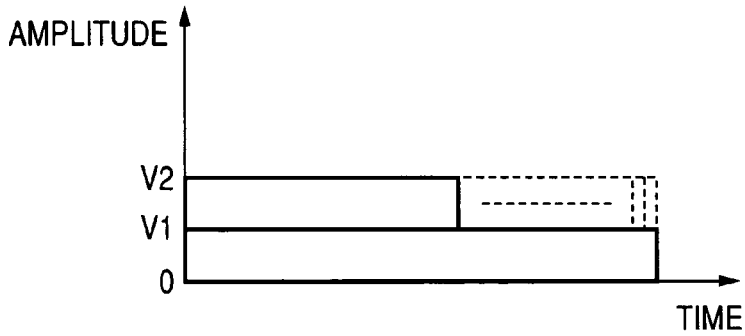
Figure 6C:
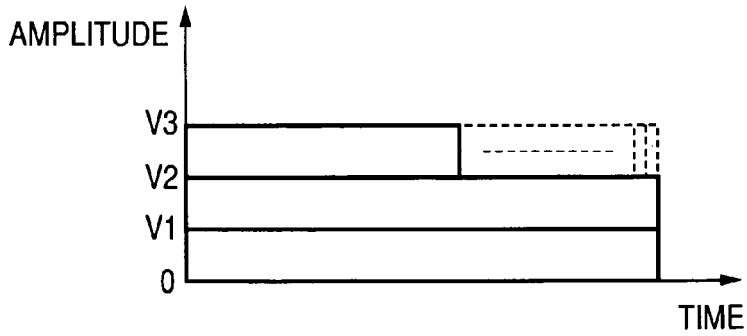
Figure 6D:
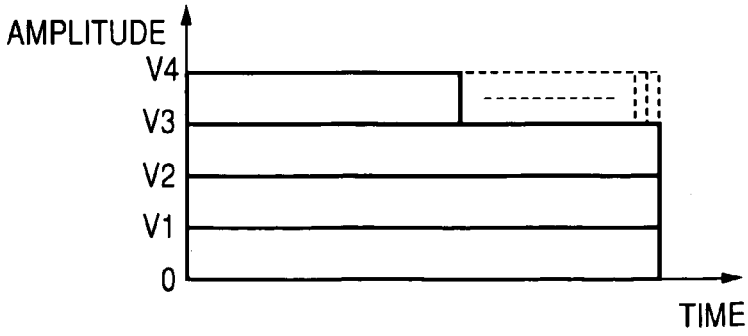

FIG. 5B shows a relationship between an input image luminance level and an output image luminance level in this embodiment. As shown in FIG. 5B, when an image is displayed using the conversion table F1 in the drive condition 2 as in the case of the drive condition 1, a relationship as indicated by a broken line in FIG. 5B is obtained. Therefore, a relative luminance balance of the displayed image is different from that in the drive condition 1. However, as described in this embodiment, when the conversion table is set to F2 in the drive condition 2, a relationship as indicated by a solid line in FIG. 5B is obtained. Thus, it is possible to maintain the same relative luminance balance as that in the case where the conversion table is set to F1 in the drive condition 1.

As described above, the conversion table shown in FIG. 5A is set such that a relative value of the output image luminance level to the input image luminance level in the drive condition 1 is equal to that in the drive condition 2.

Third Embodiment

In an image display apparatus according to a third embodiment, a pulse width modulation method using a plurality of voltage amplitude levels is employed for the modulation circuit 103 shown in FIG. 2. Other structures are identical to those in the first embodiment and thus the description is omitted here.

The modulation circuit 103 in this embodiment outputs a modulation pulse composed of combinations of plural stages of amplitudes and plural stages of pulse widths corresponding to the modulation signal information I'1 to I'n sent from the line memory 109. For example, when the modulation pulse is composed of four stages of amplitudes, four power source voltages V1, V2, V3, and V4 are used as power source voltages for modulation signal.

An example of a modulation pulse waveform outputted corresponding to each modulation level of the modulation signal information will be described with reference to FIGS. 6A to 6D. FIGS. 6A to 6D are graphs showing a concept of output pulse waveforms in the case where a relationship among the respective power source voltages for modulation signal is V1<V2<V3<V4.

Each of the pulse waveforms can be broadly divided into four groups. For example, the following groups are determined.

(a) Modulation Level is 1 to L1max

An amplitude of a pulse is V1 and a pulse width thereof is changed according to the modulation level.

(b) Modulation Level is (L1max+1) to L2max

An amplitude of a pulse is V1 to V2 and a pulse width of the pulse having the amplitude of V2 is changed according to the modulation level.

(c) Modulation Level is (L2max+1) to L3max

An amplitude of a pulse is V2 to V3 and a pulse width of the pulse having the amplitude of V3 is changed according to the modulation level.

(d) Modulation Level is (L3max+1) to L4max

An amplitude of a pulse is V3 to V4 and a pulse width of the pulse having the amplitude of V4 is changed according to the modulation level.

In a structural example of the image display apparatus according to the third embodiment of the present invention, the respective power source voltage values for modulation signal can be also changed according to the display mode selection/change signal Dmode outputted from the controller 110.

The image display apparatus according to this embodiment can display an image based on the plurality of display modes. Table 5 shows a drive voltage condition example at this time.

TABLE 5

| | Vy | V4 | V3 | V2 | V1 |
|---|---|---|---|---|---|
| Condition 1 | −10 V | +5.00 V | +3.75 V | +2.50 V | +1.25 V |
| Condition 2 | −9 V | +5.00 V | +3.75 V | +2.50 V | +1.25 V |
| Condition 3 | −9 V | +5.00 V | +4.05 V | +3.00 V | +1.90 V |

As shown in Table 5, the maximum amplitude V4 of the modulation pulses in the respective modes are equal to each other. The scanning selective signal voltages Vy from the scanning circuit 102 in the respective modes are different from each other. When a value of a light luminance portion (both Vy and Vx are applied) and a value of a dark luminance portion (Vy is applied and Vx is not applied (0V)) are measured in a dark place under the above-mentioned drive conditions, a result shown in Table 6 is obtained.

TABLE 6

| | Light Luminance Portion | Dark Luminance Portion | Dark Contrast |
|---|---|---|---|
| Condition 1 | 300 cd/m$^2$ | 0.60 cd/m$^2$ | 500:1 |
| Condition 2 | 150 cd/m$^2$ | 0.07 cd/m$^2$ | No less than 2000:1 |
| Condition 3 | 150 cd/m$^2$ | 0.07 cd/m$^2$ | No less than 2000:1 |

Therefore, a contrast ratio is high under the drive conditions 2 and 3. Thus, it is found that an image suitable to view a movie picture or the like can be displayed.

Figure 7A:
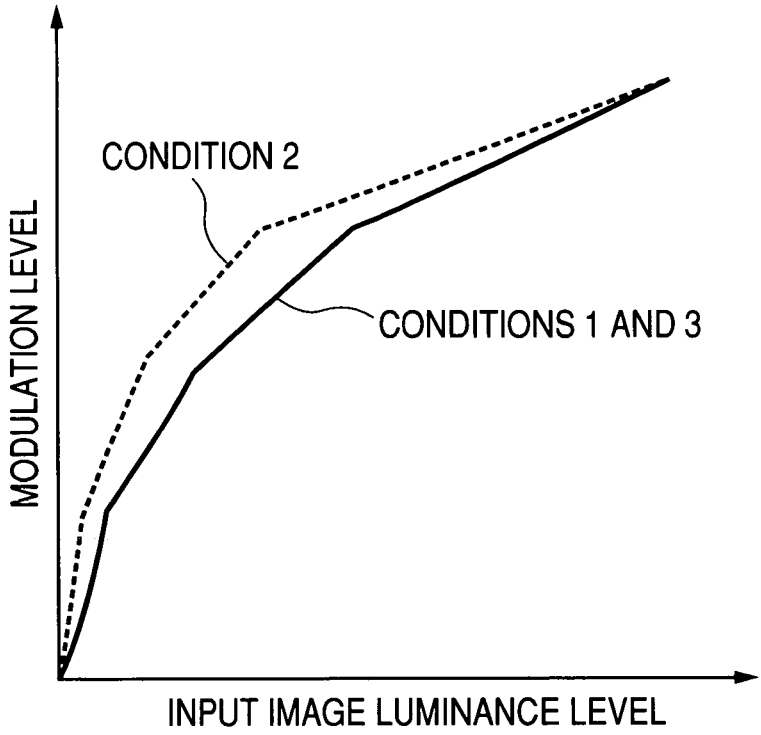
FIGS. 7A and 7B are graphs each showing a relationship between an input image luminance and a modulation level which are associated with each other by a conversion table used in the third embodiment of the present invention.

As schematically shown in FIG. 7A, modulation amplitudes are determined for the display modes in the drive conditions 1 and 2 using conversion tables having contents different from each other. Assume that the respective conversion tables are indicated by reference symbols F1 and F2.

The conversion tables corresponding to the respective display modes are stored in advance in the storing means of the luminance data converting unit 106. A corresponding conversion table is selected according to the signal Dmode. In this embodiment, the conversion table F1 is used for the drive conditions 1 and 3 and the conversion table F2 is used for the drive condition 2.

Figure 7B:
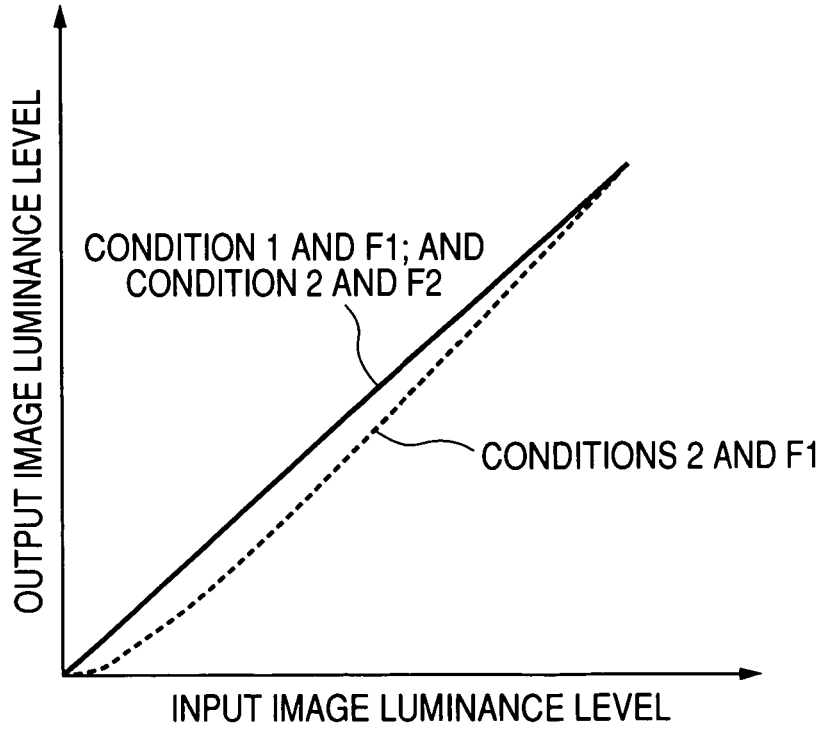

FIG. 7B shows a relationship between an input image luminance level and an output image luminance level in this embodiment. As shown in FIG. 7B, when an image is displayed using the conversion table F1 in the drive condition 2 as in the case of the drive condition 1, a relationship as indicated by a broken line in FIG. 7B is obtained. Therefore, a relative luminance balance of the displayed image is different from that in the drive condition 1. However, as described in this embodiment, when the conversion table is set to F2 in the drive condition 2, a relationship as indicated by a solid line in FIG. 7B is obtained. Thus, it is possible to maintain the same relative luminance balance as that in the case where the conversion table is set to F2 in the drive condition 2.

As described above, the conversion table shown in FIG. 7A is set such that a relative value of the output image luminance level to the input image luminance level in the drive condition 1 is equal to that in the drive condition 2.

The conversion table having the same content is used for the display modes in the drive conditions 1 and 3. However, as shown in Table 5, the voltages of V1, V2, and V3 are different from one another. These power source voltages for modulation signal can be changed according to the signal Dmode. In the example shown in Table 5, the power source voltages V1, V2, and V3 are set such that relative luminances corresponding to the modulation levels L1max to L4max in the drive condition 1 are respectively equal to those in the drive condition 3. Therefore, the power source voltages are set such that the relative value of the output image luminance level to the input image luminance level in the drive condition 1 is equal to that in the drive condition 3.

Thus, the power source for modulation signals is possibly arranged to output shifted voltage amplitude level of the modulation signals based on a voltage level difference between voltage levels of the scanning selective signal before and after changing.

Fourth Embodiment

Figure 8:
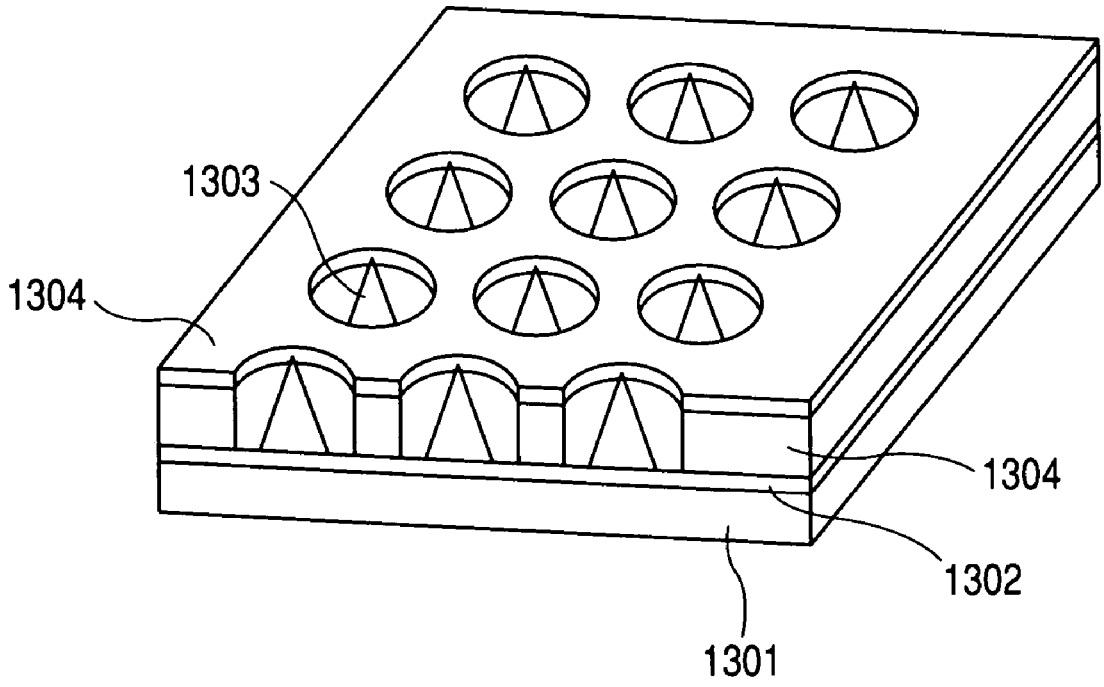
FIG. 8 is a schematic perspective view showing an FE type electron source which can be applied to the image display apparatus of the present invention.

An image display apparatus according to a fourth embodiment of the present invention will be described. In this embodiment, a Spindt type FE (field emission) device shown in FIG. 8 is used as the image forming device. In FIG. 8, the electron-emitting device includes a substrate 1301 made of glass or the like, a cathode electrode 1302 made of an electroconductive material such as aluminum, and several tens to several hundreds of cone-shaped emitters 1303 formed for each pixel, each of which is made of refractory metal such as molybdenum. The electron-emitting device further includes an insulating layer 1304 such as a silicon oxide film and a gate electrode 1305.

Even in the case of the FE electron source, a relationship between a gate-cathode voltage Vf and a luminance L in the FE device which is an image display unit (pixel unit) exhibits the characteristic shown in FIG. 1 as in the case of SCE device. Therefore, the above-mentioned relationship of Expression 2 is established.

Figure 9:
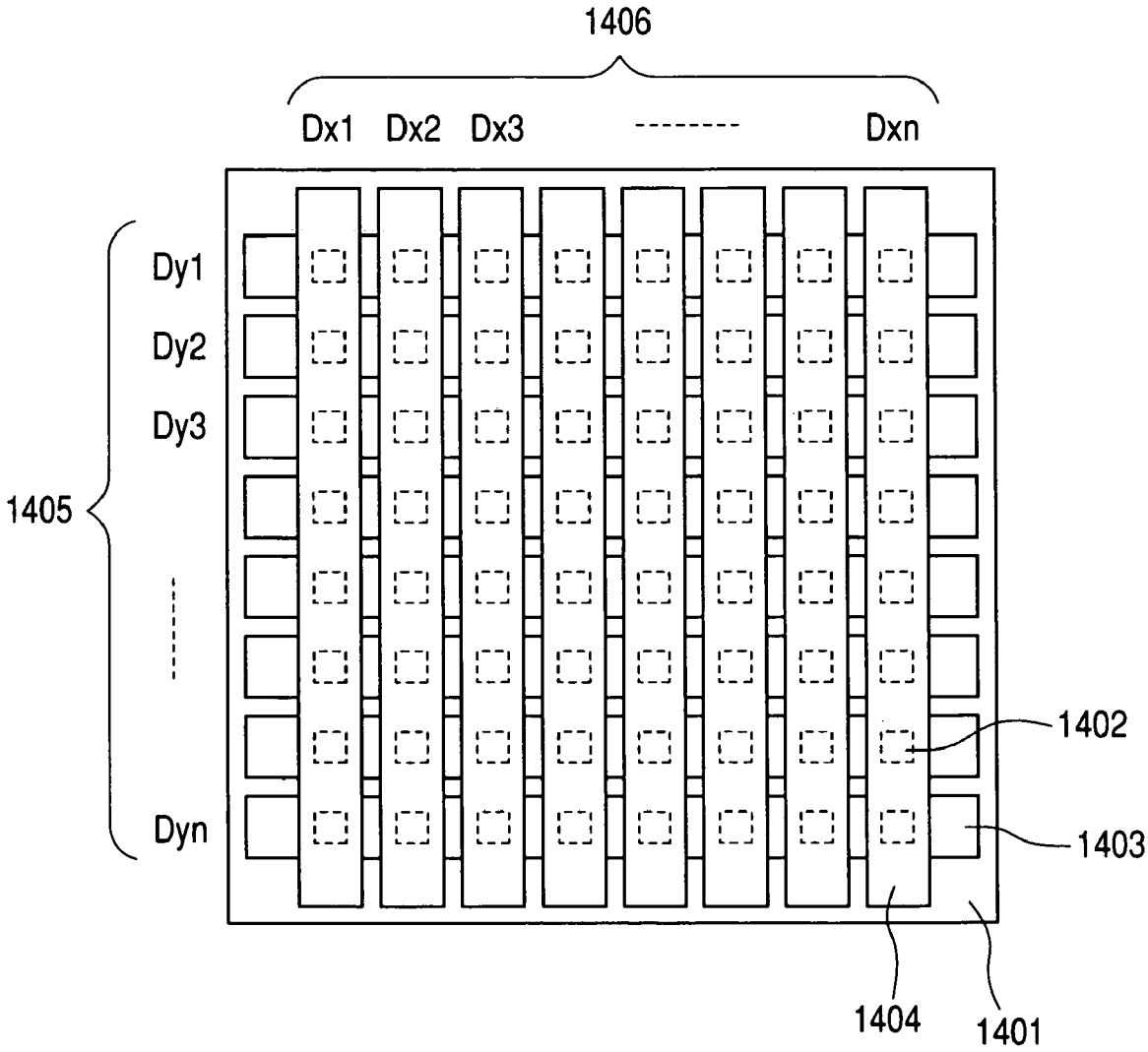
FIG. 9 is a schematic plan view showing an electron source plate composed of the FE type electron source which can be applied to the image display apparatus of the present invention.

As in the first embodiment, the display panel 101 shown in FIG. 2 is produced using an electron source plate (FIG. 9) in which a large number of FE electron-emitting devices, each of which is described above are arranged in passive matrix. In FIG. 9, the electron source plate includes a substrate 1401, electron-emitting regions 1402, in each of which a plurality of emitter cones are formed, row wirings 1403, each of which is commonly connected with cathode electrodes, column wirings 1404, each of which is commonly connected with gate electrodes, an m-row-wiring group 1405, and an n-column-wiring group 1406.

In FIG. 3, the row wiring terminals Dy1 to Dym are connected with respective common wirings with which the cathode electrodes of the FE electron source are connected. The column wiring terminals Dx1 to Dxn are connected with respective common wirings with which the gate electrodes of the FE electron source are connected. Although not shown in FIG. 2, the direct-current high voltage is applied from the high-voltage power source (not shown) to the anode electrode of the display panel 101 through the high-voltage terminal (not shown). A pulse width modulation method is used as the modulation method for the modulation circuit 103. That is, the modulation circuit 103 is a circuit using a pulse width modulation method, which generates the voltage pulse having the predetermined peak value Vx and can suitably modulate a pulse width thereof according to inputted modulation signal information.

The image display apparatus according to this embodiment can display an image based on two kinds of display modes in response to the display mode selection/change signal Dmode outputted from the controller 110. Drive voltages are set as shown in Table 7 based on the display modes.

TABLE 7

| | Vy | Vx |
|---|---|---|
| Condition 1 | −30 V | +15 V |
| Condition 2 | −27 V | +15 V |

As shown in Table 7, the amplitudes Vx of the modulation pulses in the respective modes are equal to each other. The scanning selective signal voltages Vy from the scanning circuit 102 in the respective modes are different from each other. When a value of a light luminance portion (both Vy and Vx are applied) and a value of a dark luminance portion (Vy is only applied and Vx is not applied) are measured in a dark place under the above-mentioned drive conditions, a result shown in Table 8 is obtained.

TABLE 8

| | Light Luminance Portion | Dark Luminance Portion | Dark Contrast |
|---|---|---|---|
| Condition 1 | 250 cd/m$^2$ | 0.50 cd/m$^2$ | 500:1 |
| Condition 2 | 125 cd/m$^2$ | 0.06 cd/m$^2$ | more than 2000:1 |

Therefore, a contrast ratio is high under the drive condition 2. Thus, it is found that an image suitable to view a movie picture or the like can be displayed.

The voltage values and the measurement values as shown in Tables 7 and 8 vary according to a condition for producing the FE device, a structural size thereof, a set value of an accelerating voltage, a set value of a maximal pulse width, and the like. However, in any case, when the amplitude Vx of the modulation pulse is kept constant and the value of the scanning selective signal voltage Vy is changed such that the drive voltage reduces, a contrast ratio is improved.

With respect to the conversion table of the luminance data converting unit 106, conversion tables having contents different from each other are used corresponding to the respective display modes to determine a width of the modulation pulse. Assume that the respective conversion tables are indicated by reference symbols F1 and F2.

FIG. 4A shows a relationship between the input image luminance level and an output modulation pulse width which are associated with each other by the conversion table. In FIG. 4A, an input and output relationship related to the conversion using the conversion table F1 corresponding to the drive condition 1 is indicated by a solid line and an input and output relationship related to the conversion using the conversion table F2 corresponding to the drive condition 2 is indicated by a broken line. When the input image luminance level reaches a minimal value and a maximal value, the conversion tables F1 and F2 have substantially the same output modulation amplitude value. Therefore, the relationship between the input image luminance level and the output modulation pulse width indicates a monotonic increase. Note that the conversion tables F1 and F2 are set such that an output modulation pulse width obtained by conversion using F2 becomes equal to or larger than an output modulation pulse width obtained by conversion using F1 when the input image luminance levels are equal to each other.

FIG. 4B shows a relationship between an input image luminance level and an output image luminance level in this embodiment. As shown in FIG. 4B, when an image is displayed using the conversion table F1 in the drive condition 2 as in the case of the drive condition 1, a relative luminance balance of the displayed image is different from that in the drive condition 1 (as indicated by a broken line in FIG. 4B). However, as described in this embodiment, when the conversion table is set to F2 in the drive condition 2, it is possible to maintain the same relative luminance balance as that in the case where the conversion table is set to F1 in the drive condition 1 (as indicated by a solid line in FIG. 4B).

As described above, the conversion table shown in FIG. 4A is set such that a relative value of the output image luminance level to the input image luminance level in the drive condition 1 is equal to that in the drive condition 2.

Fifth Embodiment

An image display apparatus according to a fifth embodiment of the present invention will be described.

Figure 10:
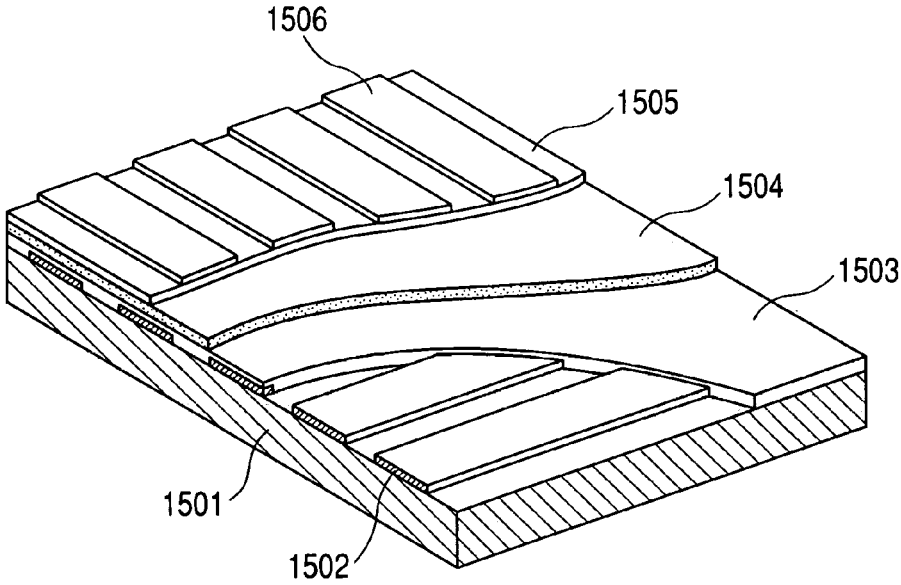
FIG. 10 is a schematic perspective view showing a display panel composed of an FE type light-emitting device which can be applied to the image display apparatus of the present invention.

In this embodiment, an inorganic EL (electro-luminescence) type light-emitting device as shown in FIG. 10 is used for the display panel. In FIG. 10, the inorganic EL type light-emitting device includes a substrate 1501 made of glass or the like, a first electrode group 1502 having transparent electrodes made of ITO or the like, a first dielectric layer 1503 stacked on the first electrode group 1502, an inorganic EL layer 1504 stacked on the first dielectric layer 1503, a second dielectric layer 1505 stacked on the inorganic EL layer 1504, and a second electrode group 1506 which is located orthogonal to the first electrode group 1502 and stacked on the second dielectric layer 1505. At this time, each of intersection portions between the first electrode group 1502 and the second electrode group 1506 composes a unit pixel.

With respect to the unit pixel of the EL type light-emitting device, a relationship between the drive voltage Vf applied between the first electrode and the second electrode and the light emission intensity (luminance) L is observed. As a result, a relationship between log (L) and Vf becomes a relationship which shows a monotonic increase in a use voltage range and draws an upwardly protruding curve, so that substantially the same characteristic as the characteristic shown in FIG. 6 is obtained. Thus, even in the EL type image forming device used in this embodiment, the above-mentioned relationship of Expression 2 is established.

The image display apparatus shown in FIG. 2 is produced using the display panel. The first electrode group is connected with the modulation circuit 103 through the wiring terminals Dx1 to Dxn. The second electrode group is connected with the scanning circuit 102 through the wiring terminals Dy1 to Dym.

In the image display apparatus shown in FIG. 2, an amplitude modulation method is used for the modulation circuit 103. That is, the modulation circuit 103 is a circuit using an amplitude modulation method, which generates a voltage pulse having a predetermined pulse width and can suitably modulate a peak value thereof according to inputted modulation signal information. A maximal peak value of the pulse voltage is specified by using the power source voltage Vx.

The image display apparatus according to this embodiment can display an image based on two kinds of display modes in response to the display mode selection/change signal Dmode outputted from the controller 110. Drive voltage conditions at this time are shown in Table 9.

TABLE 9

| | Vy | Vx |
|---|---|---|
| Condition 1 | −100 V | +50 V |
| Condition 2 | −92 V | +50 V |

As shown in Table 9, the maximum amplitudes Vx of the modulation pulses in the respective modes are equal to each other. The scanning selective signal voltages Vy from the scanning circuit 102 in the respective modes are different from each other. When a value of a light luminance portion (both Vy and Vx are applied) and a value of a dark luminance portion (Vy is only applied and Vx is applied at the minimum output level) are measured in a dark place under the above-mentioned drive conditions, a result shown in Table 10 is obtained.

TABLE 10

| | Light Luminance Portion | Dark Luminance Portion | Dark Contrast |
|---|---|---|---|
| Condition 1 | 200 cd/m$^2$ | 0.40 cd/m$^2$ | 500:1 |
| Condition 2 | 100 cd/m$^2$ | 0.05 cd/m$^2$ | No less than 2000:1 |

Therefore, a contrast ratio is high under the drive condition 2. Thus, it is found that an image suitable to view a movie picture or the like can be displayed.

With respect to the conversion table of the luminance data converting unit 106, conversion tables having contents different from each other are used corresponding to the respective display modes to determine a width of the modulation pulse. Assume that the respective conversion tables are indicated by reference symbols F1 and F2.

FIG. 5A shows a relationship between the input image luminance level and an output modulation amplitude which are associated with each other by the conversion table. In FIG. 5A, an input and output relationship related to the conversion using the conversion table F1 corresponding to the drive condition 1 is indicated by a solid line and an input and output relationship related to the conversion using the conversion table F2 corresponding to the drive condition 2 is indicated by a broken line. When the input image luminance level reaches a minimal value and a maximal value, the conversion tables F1 and F2 have substantially the same output modulation amplitude value. Therefore, the relationship between the input image luminance level and the output modulation amplitude indicates a monotonic increase. Note that the conversion tables F1 and F2 are set such that an output modulation amplitude value obtained by conversion using F2 becomes equal to or larger than an output modulation amplitude value obtained by conversion using F1 when the input image luminance levels are equal to each other.

FIG. 5B shows a relationship of an input image luminance level and an output image luminance level in this embodiment. As shown in FIG. 5B, when an image is displayed using the conversion table F1 in the drive condition 2 as in the case of the drive condition 1, a relative luminance balance of the displayed image is different from that in the drive condition 1 (as indicated by a broken line in FIG. 5B). However, as described in this embodiment, when the conversion table is set to F2 in the drive condition 2, it is possible to maintain the same relative luminance balance as that in the case where the conversion table is set to F2 in the drive condition 2 (as indicated by a solid line in FIG. 5B).

As described above, the conversion table shown in FIG. 5A is set such that a relative value of the output image luminance level to the input image luminance level in the drive condition 1 is equal to that in the drive condition 2.

Figure 11:
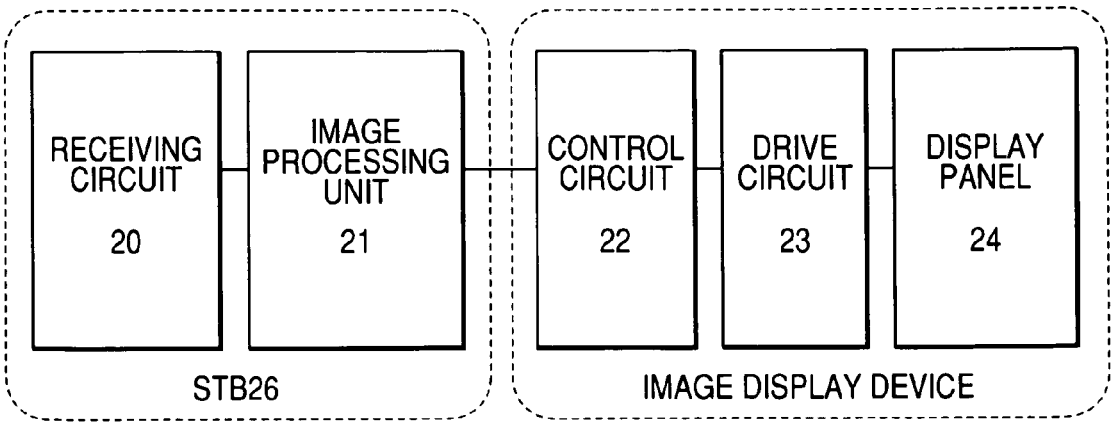
FIG. 11 is a block diagram showing a television apparatus of the present invention.

FIG. 11 is a block diagram showing a television apparatus according to the present invention. A receiving circuit 20 is composed of a tuner, a decoder, and the like. The receiving circuit 20 receives a television signal on satellite broadcasting or terrestrial broadcasting, a signal on data broadcasting through a network, or the like and outputs decoded video data to an image processing unit 21. The image processing unit 21 includes a gamma correction circuit, a resolution converting circuit, and an I/F unit. The image processing unit 21 converts image-processed video data into a display format of an image display apparatus 25 and outputs image data to the image display apparatus 25. The image display apparatus 25 includes a display panel 24, a drive circuit 23, and a control circuit 22. The control circuit 22 performs image processing such as correction processing suitable for the display panel on the inputted image data and outputs the image data and various control signals to the drive circuit 23. The drive circuit 23 outputs drive signals to the display panel 24 based on the inputted image data, thereby displaying a video image.

The receiving circuit 20 and the image processing unit 21 may be stored in a case which serves as a set-top box (STB 26) and is separated from the image display apparatus 25. The receiving circuit 20 and the image processing unit 21 may be stored in the same case as that storing the image display apparatus 25.

This application claims priority from Japanese Patent Application No. 2004-076108 filed on Mar. 17, 2004, which is hereby incorporated by reference herein.

What is claimed is:

1. An image display apparatus, comprising:

a plurality of image forming devices which are driven through a plurality of row wirings and a plurality of column wirings and arranged in a matrix for image formation;

scanning means for successively selecting the row wirings to output a selective signal to a selected row wiring, and to output a non-selective signal to a non-selected row wiring;

modulation means for outputting modulation signals corresponding to image data, which are applied to the column wirings; and scanning voltage control means for commanding to change a voltage level of the selective signal in response to a display control signal, the scanning means setting a voltage level of the selective signal in response to a scanning voltage control signal received from the scanning voltage control means, wherein provided that where a light emission luminance value obtained when a drive voltage v is applied to each of the image forming devices is given by L(v), a first-order differential coefficient of the light emission luminance value L(v) to the drive voltage v is given by L'(v). and a second-order differential coefficient thereof is given by L"(v), $$L'(v)>0 \text{ and } L''(v)\times L(v)<\{L'(v)\}^2$$

are satisfied in a range of the drive voltage v for image display.

2. An image display apparatus according to claim 1, further comprising a plurality of conversion tables, each of which includes an output modulation signal to a luminance level of input image data, wherein the modulation means outputs the modulation signals based on modulation signal information obtained from the conversion tables in accordance with the input image data.

3. An image display apparatus according to claim 2, wherein the conversion table is selected such that characteristics of display luminance levels to luminance levels of the input image data become equal to one another.

4. An image display apparatus according to claim 1, wherein the modulation means outputs the modulation signals which are voltage signals, each of which has a plurality of voltage amplitude levels and is subjected to pulse width modulation based on a luminance level of input image data.

5. An image display apparatus according to claim 4, wherein the plurality of voltage amplitude levels of the modulation signals are shifted before and after the voltage level of the selective signal is changed.

6. An image display apparatus according to claim 1, wherein the voltage level of the selective signal is changed in response to a request from a user or discernment of sort of image source.

7. An image display apparatus, comprising:

a plurality of image forming devices which are driven through a plurality of row wirings and a plurality of column wirings and arranged in a matrix for image formation;

scanning means for successively selecting the row wirings to output a selective signal to a selected row wiring, and to output a non-selective signal to a non-selected row wiring;

modulation means for outputting modulation signals to the column wirings which has a plurality of voltage amplitude levels and is subjected to pulse width modulation based on image data;

means for changing a voltage level of the selective signal in response to a request from a user; and means for shifting the voltage amplitude level of the modulation signals based on a voltage level difference between voltage levels of the selective signal before and after changing of the voltage level of the selective signal, wherein provided that where a light emission luminance value obtained when a drive voltage v is applied to each of the image forming devices is given by L(v), a first-order differential coefficient of the light emission luminance value L(v) to the drive voltage v is given by L'(v), and a second-order differential coefficient thereof is given by L"(v), $$L'(v)>0 \text{ and } L''(v)\times L(v)<\{L'(v)\}^2$$

are satisfied in a range of the drive voltage v for image display.

8. A method of controlling an image display apparatus including a plurality of image forming devices which are driven through a plurality of row wirings and a plurality of column wirings and arranged in a matrix for image formation, the method comprising:

successively selecting the row wirings to output a selective signal to a selected row wiring, and to output a non-selective signal to a non-selected row wiring;

outputting modulation signals corresponding to image data, which are applied to the column wirings;

outputting a scanning voltage control signal for commanding to change a voltage level of the selective signal in response to a display control signal; and outputting the selective signal to the selected row wiring whose voltage level is changed in response to the scanning voltage control signal, wherein provided that where a light emission luminance value obtained when a drive voltage v is applied to each of the image forming devices is given by L(v), a first-order differential coefficient of the light emission luminance value L(v) to the drive voltage v is given by L'(v), and a second-order differential coefficient thereof is given by L"(v), $$L'(v)>0 \text{ and } L''(v)\times L(v)<\{L'(v)\}^2$$

are satisfied in a range of the drive voltage v for image display.

9. A television apparatus, comprising:

the image display apparatus according to claim 1;

an image processing unit; and a receiving circuit for receiving a television signal and outputting an input luminance signal to the image processing unit, wherein the image display apparatus displays a video based on image data outputted from the image processing unit.

10. A television apparatus, comprising:

the image display apparatus according to claim 7, an image processing unit; and a receiving circuit for receiving a television signal and outputting an input luminance signal to the image processing unit, wherein the image display apparatus displays a video based on image data outputted from the image processing unit.

* * * * *